United States Patent [19]

Andres et al.

[11] Patent Number: 4,503,906

[45] Date of Patent: Mar. 12, 1985

[54] SURFACE HEATER STRUCTURE, ESPECIALLY FOR VEHICLES

[75] Inventors: Rudolf Andres; Helmut Grantz, both of Sindelfingen; Wolf-Dietrich Münzel, Ehningen; Wolfgang Odebrecht, Sindelfingen, all of Fed. Rep. of Germany

[73] Assignee: Daimler-Benz Aktiengesellschaft, Fed. Rep. of Germany

[21] Appl. No.: 439,184

[22] Filed: Nov. 4, 1982

[30] Foreign Application Priority Data

Nov. 6, 1981 [DE] Fed. Rep. of Germany ..... 3144089

[51] Int. Cl.[3] ..... F28D 15/00

[52] U.S. Cl. ..... 165/104.21; 165/104.14; 165/140; 29/157.3 V; 219/326; 219/341; 219/378

[58] Field of Search ..... 165/104.21, 104.14, 165/140; 62/333, 516, 519, 523; 29/157.3 V; 219/326, 341, 378

[56] References Cited

U.S. PATENT DOCUMENTS

| | | | |
|---|---|---|---|
| 2,000,455 | 5/1935 | Ralston et al. | 165/104.21 |
| 2,432,931 | 12/1947 | Peltier | 62/333 |
| 2,924,437 | 2/1960 | Wilkins | 29/157.3 V |
| 3,209,062 | 9/1965 | Scholz | 165/104.21 |

FOREIGN PATENT DOCUMENTS

| | | | |
|---|---|---|---|
| 2730541 | 1/1978 | Fed. Rep. of Germany | 165/104.21 |

*Primary Examiner*—Albert W. Davis, Jr.
*Attorney, Agent, or Firm*—Craig & Burns

[57] ABSTRACT

A surface heater body which is constructed as two-layer, expanded partial composite laminated body and contains two mutually separated channels or channel systems adjoining one another wall-to-wall in a heat-conducting manner; one channel system which extends over the entire area of the surface heater body and which is hermetically closed off, operates as heat-pipe to distribute the supplied heat over a large area; a heat channel traversed by heating water extends along the bottom edge of the surface heater body; a rectilinear continuous non-expanded strip is provided between the heat channel and the heat-pipe channel system, along which the partial composite laminated body is bent U-shaped so that the heat channel and the heat-pipe channel system come into mutual abutment where they are permanently and heat-conductingly connected with each other over the entire contact surface; a separate pipe may also be provided as heat channel or, as a still further alternative, a heat-pipe may be inserted into the heat-pipe channel system whereby the two edges of the surface heater body are sealed off at the places where the heat pipe leaves the heater element.

3 Claims, 13 Drawing Figures

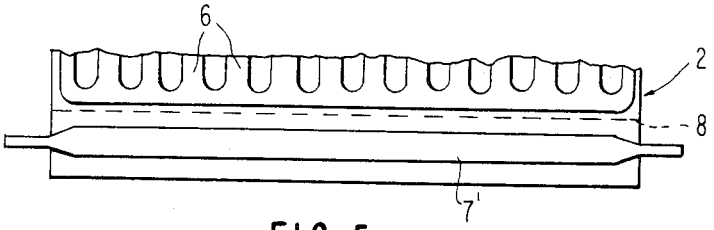
FIG. 5
FIG. 8
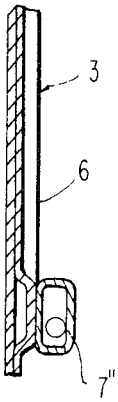
FIG. 7
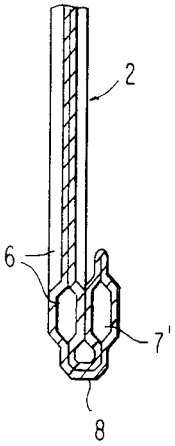
FIG. 6
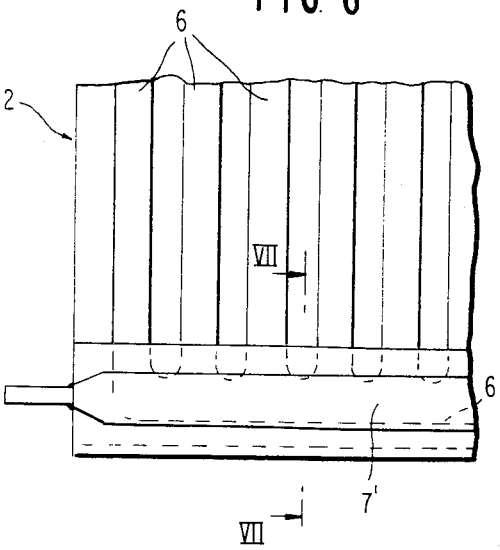
FIG. 9
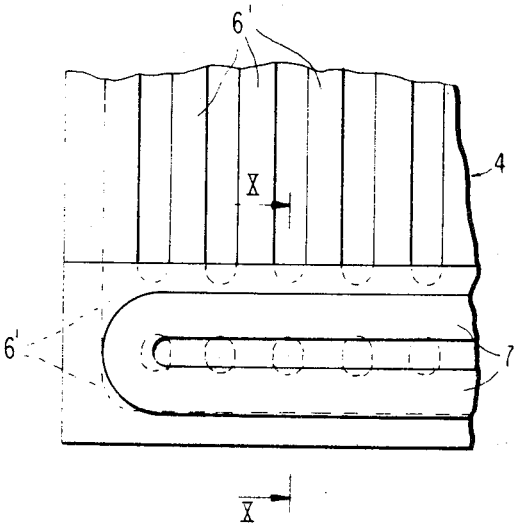
FIG. 10
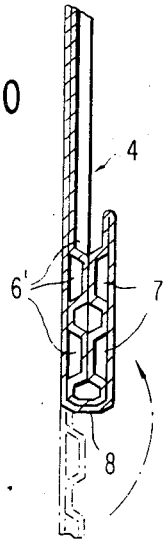

SURFACE HEATER STRUCTURE, ESPECIALLY FOR VEHICLES

The present invention relates to a surface heater structure, especially for vehicles, generally of the type as described, for example, in the non-prepublished German Offenlegungsschrift No. 30 41 710.

The prior art surface heater body is constructed as three-layer expanded partial composite laminated body for the formation of the two separate channels, respectively, channel systems. Since, however, the heating channel is required only within a relatively narrow section of the surface heater body, the third layer is unnecessary over the largest part. As a result thereof, the surface heater body not only becomes unnecessarily heavy, but also an unnecessarily large amount of material is used for the manufacture thereof. It would, of course, be feasible to provide the third layer with a separating substance within the area of the non-needed area and to tear it off subsequently. While the weight of the surface heater body would be reduced thereby, nonetheless also with this type of manufacture an unnecessarily large amount of material would be used because the removed part of the third layer would only have scrap value. Therebeyond, a penetration of the weld may occur over such a large area during the rolling down of the laminated body, notwithstanding the separating substance, so that the third layer cannot be removed in a clean manner.

It is the aim of the present invention to manufacture the surface heater body of the type described above, as light-weight as possible and with smallest possible material expenditure.

This task can be solved according to the present invention in three ways which are each characterized individually by the characterizing features of the claims. In any case, only a two-layered partial composite laminated body is used and the heating channel is subsequently connected in a heat-transferring manner with the thus formed heat-pipe channel system.

These and other objects, features and advantages of the present invention will become more apparent from the following description when taken in connection with the accompanying drawing which shows, for purposes of illustration only, several embodiments in accordance with the present invention, and wherein:

FIG. 5 is a partial side elevational view of a further embodiment of a surface heater body in accordance with the present invention with a continuous rectilinear heat channel, showing the parts thereof in the extended position;

FIG. 6 is a partial side elevational view of the surface heater body of FIG. 5 with the parts thereof in the completed condition;

FIG. 7 is a partial cross-sectional view taken along line VII—VII, of FIG. 6;

FIG. 8 is a cross-sectional view through a still further embodiment of a surface heater body in accordance with the present invention with a laterally brazed-on rectangular pipe as heating channel;

FIG. 9 is a partial side view of still another embodiment of a surface heater body in accordance with the present invention having a U-shaped heating channel, which are brazed to one another at their expanded side;

FIG. 10 is a partial cross-sectional view, taken along line X—X of FIG. 9;

Figure 1:
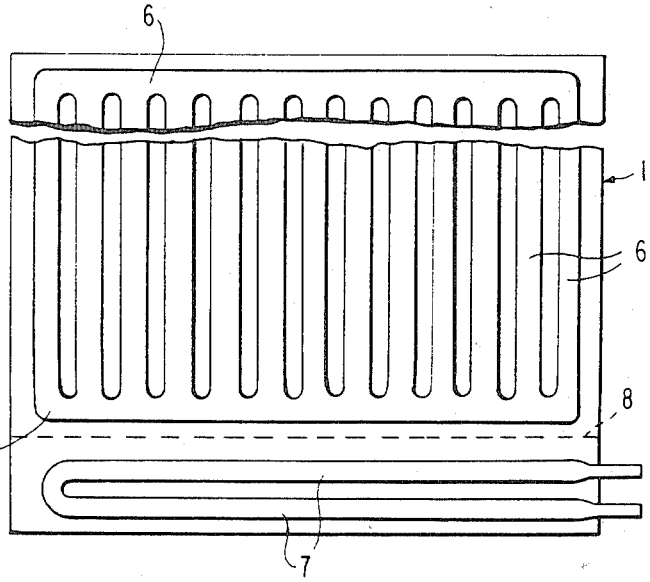
FIG. 1 is a side elevational view of a first embodiment of a surface heater body according to the present invention in its extended position prior to its completion.
Figure 2:
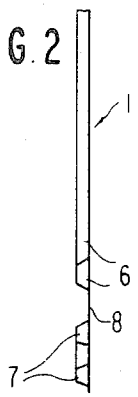
FIG. 2 is a longitudinal elevational view of the surface heater body of FIG. 1.
Figure 4:
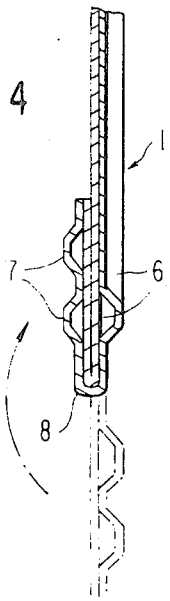
FIG. 4 is a cross-sectional view, taken along line IV—IV of FIG. 3.
Figure 3:
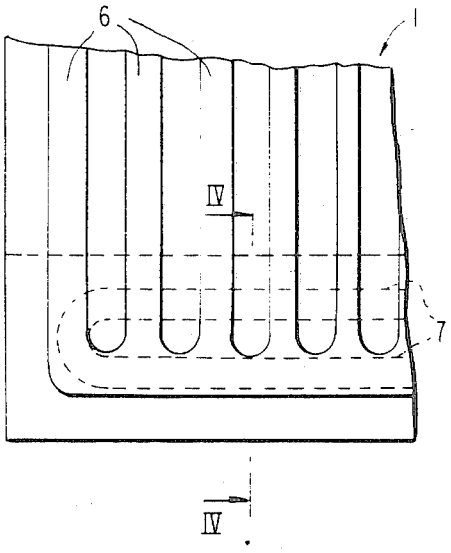
FIG. 3 is a partial side elevational view, on a somewhat larger scale, showing the surface heater body of FIG. 1 in its completed condition.

Referring now to the drawing wherein like reference numerals are used throughout the various views to designate like parts, the surface heater body generally designated by reference numeral 1 illustrated in FIGS. 1 to 4 includes an essentially ladder-shaped heat-pipe channel system 6 as well as a U-shaped heat channel 7, which is provided with connections leading to the outside so that heating water can be conducted therethrough. Both channels, respectively, channel systems are formed in a two-layer expanded partial composite laminated body, whereby a rectilinear non-expanded strip 8 extending uninterruptedly to the edge is left between the heat channel 7 and the heat-pipe channel system 6. This strip 8 is bent U-shaped until the heat channel 7 abuts flat on the heat-pipe channel system 6 and is permanently connected heat-conductingly along the contact surfaces which can take place, for example, by furnace brazing or by heat-conducting bonding. In the embodiment illustrated in FIGS. 1–4, the partial composite laminated body is expanded exclusively toward one side and the opposite side is flat and plane. The flat side of the partial composite laminated body serves as abutment side of the two channels, respectively, channel systems. A mutual abutment over a particularly large area and a correspondingly good heat flow result therefrom. The U-shaped construction of the heat channel 7 offers the advantage that the in-flow and out-flow are arranged at the same edge of the surface heater body so that a webbed-hose-line corresponding to the distance of the two pipe connections can be used as supply and discharge line. Additionally, larger heat quantities can be transferred by means of a U-shaped heat channel than with an exclusively rectilinear continuous heat channel.

The embodiment illustrated in FIGS. 9 and 10 of a surface heater body generally designated by reference numeral 4, also includes a U-shaped heat channel 7, whereby also the heat channel 7 is formed of the two-layer partial composite laminated body. In this embodiment, which is also constructed flat and plane on one side, the bending, however, takes place to the other side as in the embodiment of FIGS. 1 to 4 so that the two channels, respectively, channel systems abut at each other along their expanded sides and are connected thereat with each other in a heat-conducting manner. This embodiment offers the advantage compared to the embodiment according to FIGS. 1 to 4 that one side of the surface heat exchanger is constructed completely smooth and plane which may be decisive in certain applications. The heat-pipe channel system 6′ for this surface heat exchanger includes within the area of its bottom side, two longitudinally extending channel sections which are connected with each other ladder-shaped by short cross channels. As a result thereof, a large mutual contact surface is created with the U-shaped heat channel 7 so that also in this embodiment a good heat transfer is attainable.

In the embodiment of the surface heat exchanger generally designated by reference numeral 2 according to FIGS. 5 to 7, a rectilinear continuous heat channel 7′ is provided which is also integrated into the two-layer partial composite laminated body; the two pipe connections are thereby arranged at opposite side edges of the surface heater body. This partial composite laminated body is expanded toward both sides, which permits on both sides equally thin sheet metal layers, i.e., a weight-saving. Additionally, larger internal cross sections can be produced in the channels, respectively, in the channel systems.

In the embodiment of a surface heat-exchanger generally designated by reference numeral 3 according to FIG. 8, the heat channel 7″ is not integrated into the two-layered partial composite laminated body; instead, the latter contains only the heat-pipe channel system 6 which, in this embodiment, is also expanded only to one side so that one side of the surface heater body is constructed completely smooth and plane. Along the lower side of the surface heater body a rectangular pipe is brazed-on as heat channel so that a good heat transfer is realized between the two. Of course, also other cross sections may be provided for the pipe forming the heat channel, for example, also circular pipes. In that case, it is appropriate to form a corresponding complementary counter-contour at the lower channel section of the heat-pipe channel system 6 so that also with such cross-sectional shapes a large heat transfer surface will result.

Figure 11:
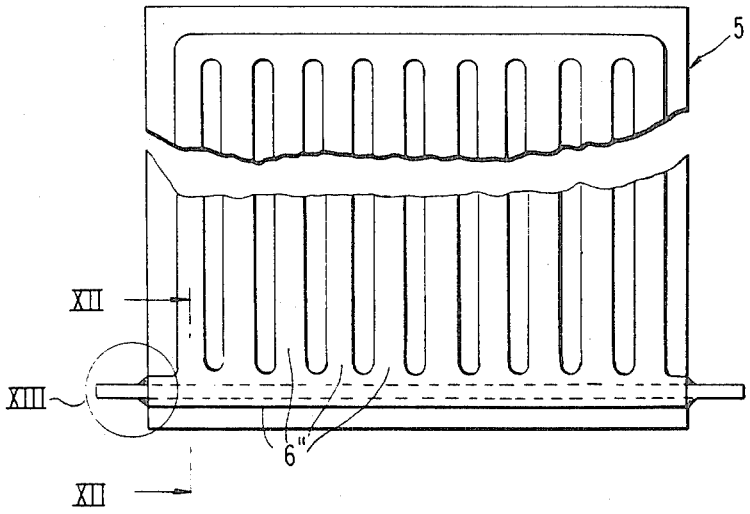
FIG. 11 is a side-elevational view of still a further embodiment of a surface heater body in accordance with the present invention with a pipe-shaped heat channel inserted into the heat-pipe channel system.
Figure 12:
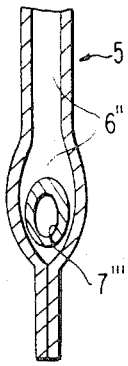
FIG. 12 is a partial cross-sectional view taken along line XII—XII of FIG. 11.
Figure 13:
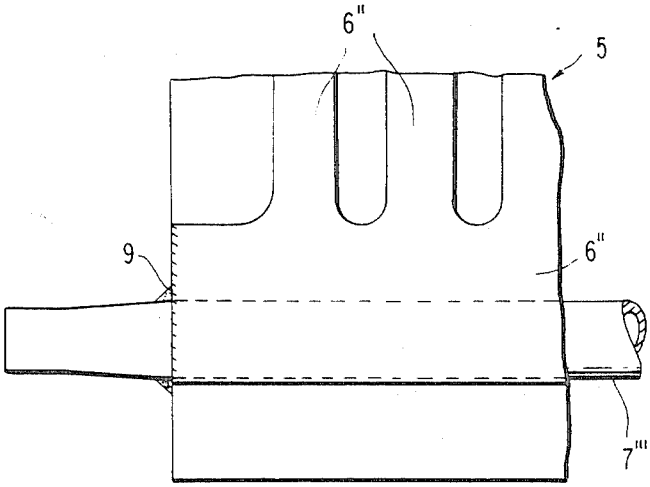
FIG. 13 is a partial side elevational view, on an enlarged scale, showing the details of FIG. 11 indicated by circle XIII.

In the last embodiment of the surface heater body generally designated by reference numeral 5 according to FIGS. 11 to 13, a separate pipe is also provided as heat channel 7‴ which is subsequently brought into connection with the heat-pipe channel system 6″. More particularly, the lowermost channel section of the heat-pipe channel system 6″ extends up to the rim edges of the surface heater body and is initially open thereat. The pipe of the heat channel which is appropriately oval in cross section, is installed into these openings; subsequently, the passage place is closed by a corresponding shaping of the wall parts and is sealed off by a welded joint 9. In lieu of a welded connection, also a brazed connection may be provided.

Partial composite laminated bodies, as the term is used herein are such structures, also known as so-called "Roll-Bond" plates, which consist of a corresponding number of aluminum plates that, for example, are imprinted with a separating substance at those places where the plates are intended to form hollow spaces and are subsequently rolled together one lying upon the other, as a result of which the plates are intimately welded together by the rolling pressure and the material deformation at the non-imprinted places. By blowing compressed air into the non-welded places, the gaps located thereat are inflated or expanded into channels whereby a corresponding shaping tool assures a defined pneumatic channel enlargement.

While we have shown and described several embodiments in accordance with the present invention, it is understood that the same is not limited thereto, but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A surface heater structure which is constructed as expanded partial composite laminated body means and which contains two mutually separated channel means, adjoining one another wall-to-wall in a heat-conducting manner, of which one channel means that is hermetically closed and extends over substantially the entire surface of the surface heater body means forming a heat-pipe channel system, is constructed and operates as heat-pipe means, and of which another channel means extending along the lower side of the surface heater body means which forms a heat channel, is adapted to be traversed by heating water, characterized in that the partial composite laminated body means is constructed as two-layer body and includes a substantially rectilinear continuous non-expanded strip means between the heat channel and the heat-pipe channel system, said body means being bent U-shaped along this strip for mutual abutment of the heat channel and of the heat-pipe channel system, and in that the mutually abutting wall parts thereof are heat-conductingly connected with each other over substantially the entire contact area.

2. A surface heater structure according to claim 1, characterized in that the mutually abutting wall parts are brazed to each other.

3. A surface heater structure according to claim 1, characterized in that the mutually abutting wall parts are bonded with each other in a heat-conducting manner.

* * * * *